United States Patent [19]

McAllister

[11] Patent Number: 4,811,750

[45] Date of Patent: Mar. 14, 1989

[54] CANE WITH EXTENSIBLE FINGERS

[76] Inventor: John M. McAllister, 2525 Wake Dr., Raleigh, N.C. 27608

[21] Appl. No.: 206,282

[22] Filed: Jun. 14, 1988

[51] Int. Cl.[4] ..... A45B 3/00

[52] U.S. Cl. ..... 135/66; 135/84

[58] Field of Search ..... 135/66, 70, 81, 84

[56] References Cited

U.S. PATENT DOCUMENTS

| | | | |
|---|---|---|---|
| 404,303 | 5/1889 | Remillard | 135/70 |
| 3,093,402 | 6/1963 | Sisson | 135/66 |
| 3,467,116 | 10/1969 | Ringewaldt | 135/66 X |
| 3,763,872 | 10/1973 | Gooley | 135/66 |
| 3,977,422 | 8/1976 | Cabaluna | 135/66 X |
| 4,364,405 | 12/1982 | Norwood et al. | 135/81 |

*Primary Examiner*—J. Karl Bell

*Attorney, Agent, or Firm*—Rhodes, Coats & Bennett

[57] ABSTRACT

The present invention entails a cane having a finger assembly in the lower portion thereof and extendable from the cane for gripping objects. In particular, the finger assembly is biased toward an extended position. A locking mechanism enables the finger assembly to be locked in an infinite number of positions between a fully extended position and a fully retracted position such that objects of various sizes can be retrieved and held.

12 Claims, 3 Drawing Sheets

CANE WITH EXTENSIBLE FINGERS

FIELD OF THE INVENTION

This invention relates to canes and more particularly to canes having an extensible finger assembly for retrieving and holding objects.

BACKGROUND OF THE INVENTION

Often times, through handicap or infirmity, a person is unable to perform simple motor tasks which others can easily do, or he himself was able to do before his physical condition became altered. Such physical alterations include the stiffening and impaired movement of the joints accompanying arthritis, diseases or conditions of the muscles, bones, tendons, or nerves which limit mobility, especially in the hands, and problems relating to the back or hips which impede one's ability to stoop or bend over. Such conditions occur in conjunction with or as a result of accident, illness, injury, a congenital condition or the so-called aging process.

At any rate, a person so impaired has many occasions daily to be frustrated by his inability to perform simple tasks, for example, picking up a dropped glove or other personal article, or gathering the morning paper, or picking up refuse along one's walk and depositing it in a waste can.

Being able to do such simple jobs for oneself rather than being helpless or having to always call on another individual, adds considerably to one's independence, self-esteem and indeed, happiness.

To date, the canes with extensible finger assemblies which have been developed, while easily operable by a physically normal person, could prove difficult for persons of limited flexibility and strength.

In addition, other cane apparatuses have no means of reliably locking the gripping fingers around an object. Thus, objects, especially weightier ones, are apt to drop from the cane as it is raised up.

The shortcomings of prior art canes with extending fingers is exemplified in the disclosure of U.S. Pat. No. 3,093,402. In this patent, the user is required to depress a spring through a thumb button in order to extend the fingers as they are biased in a retracted position. The user must hold the thumb button down until an object is positioned between the gripping fingers, which is very fatiguing. Also, in this patent the expansive strength of the thumb button spring as the thumb button is released is what retracts the fingers and thusly, keeps them clamped around the object. Therefore, a spring which could be easily depressed by an impaired person would have only enough expansive strength to hold relatively light objects.

Further limitations of prior art canes are exemplified in U.S. Pat. No. 3,763,872. This invention employs a telescoping post within the cane from which gripping fingers are biased outwardly. Manual pressure on the cane causes the post to telescope into the cane and draw the fingers inwardly toward the post and around the object. It is only the frictional engagement between the post and fingers and the cane tube that maintains their relative position as the cane is lifted. It can be seen that any significant weight, exerting a downward force, will pull the telescoping tube out of the cane and cause the object to fall, depending on how much pressure was exerted on the cane pursuant to retrieving the object.

SUMMARY AND OBJECTS OF THE INVENTION

The present invention is a cane having a finger assembly moveably mounted within the cane through use of which an impaired person might pick up and retrieve a variety of objects.

Broadly, the cane comprises a hollow column through the end of which the finger assembly moves from a retracted closed position to .an extended open position. A spring disposed within the cane body biases the finger assembly toward the extended open position. The finger assembly is retracted by pressing the cane toward the finger assembly while the fingers abut a surface such as the floor. As the finger assembly is retracted, it may be locked in any number of positions by a cam-type locking mechanism, which automatically assumes a locking position whenever pressure on the cane is relieved.

It is, therefore, an object of the present invention to provide a cane with auxiliary gripping fingers which are capable of grasping and holding objects of various shapes, sizes, and weights.

It is another object of the present invention to provide a cane with an extensible finger assembly for gripping and holding objects which extends automatically from the cane and retracts within same.

It is another object of the present invention to provide a cane in which the extensible finger assembly is automatically lockable in any position between a fully extended, open position and a retracted, closed position.

It is another object of the present invention to provide a cane with an extensible finger assembly which allows a continuous range of positions between a fully extended, open position and a retracted, closed position.

It is yet another object of the present invention to provide a cane with an extensible finger assembly that can retrieve and hold objects of a variety of shapes, sizes, and weights.

It is also an object of the present invention to provide a cane whose extensible fingers are cushioned at their ends by cone-shaped tips which aid in retrieving fragile objects.

It is a further object of the present invention to devise a cane with extensible finger assembly which is easy for an infirm person to understand and use, and which requires very little manual dexterity and strength.

It is another object of the present invention to devise a cane with extensible finger assembly which does not even require a hand operation but may be extended by striking a release mechanism with one's foot or against a chair rail or the like.

It is still another object of the present invention to devise a can with extensible finger assembly which incorporates only simple mechanisms in its design such as springs, cams, and levers.

It is yet another object of the present invention to provide a dual-purpose device which is both an auxiliary gripping device and a cane or walking stick.

Other objects and advantages of the present invention will become apparent and obvious from a study of the following description and the accompanying drawings which are merely illustrative of such invention.

DETAILED DESCRIPTION OF THE INVENTION

Figure 1:
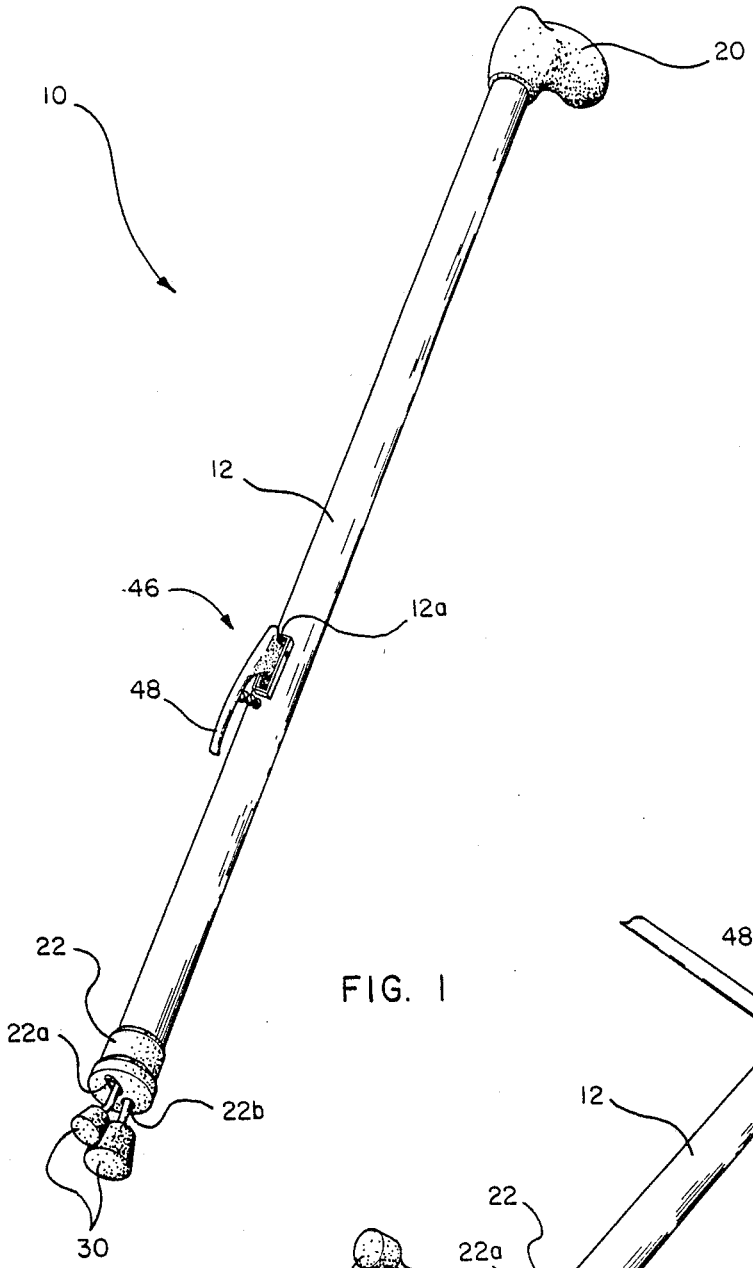
FIG. 1 is a perspective view of the cane with the gripping fingers slightly extended.

With further reference to the drawings, the cane of the present invention is shown therein and indicated generally by the numeral 10. As will be observed subsequently, the cane 10 includes an extensible finger assembly disposed in the bottom portion thereof.

Viewing the cane in detail, it is seen that the same includes a main pipe body 12 having a hollow opening 14 throughout its length. The cane body 12 has an open top 18 to receive a contoured hand grip 20. The hand grip may be made of any fairly rigid material such as wood, molded plastic or graphite, or bone. The cane body 12 has an open bottom 16 which is fitted with a bottom cap 22, in the bottom face of which are two distinct openings, **22*a* and 22*b***.

An extensible finger assembly is disposed within the lower portion of the cane body 12 and slideably engages the openings, **22*a* and 22*b*, in the bottom cap 22**.

The finger assembly is viewed in longitudinal cross-section in FIGS. 3 through 6 and indicated generally by the numeral 24.

Figure 3:
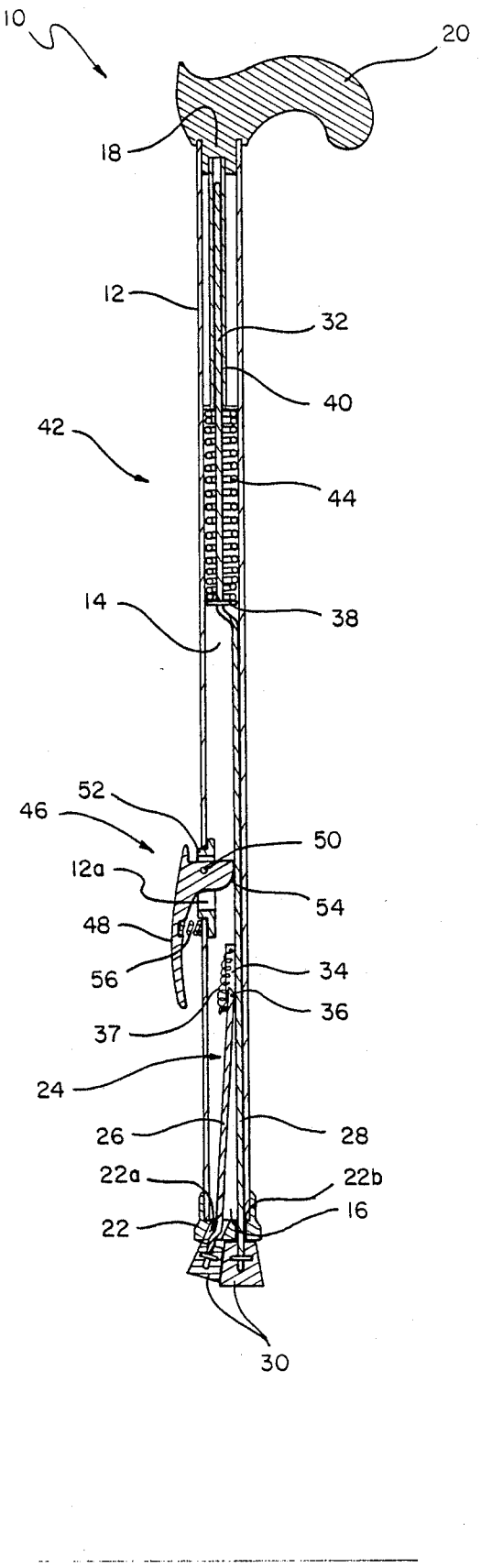
FIG. 3 is a longitudinal cross-sectional view of the cane with the finger assembly in the fully retracted and locked position.

In FIG. 3, the gripping fingers 26 and 28 are in their fully retracted and locked position. The lowermost ends of fingers 26 and 28 are enveloped by cushioning cone-like tips 30. The lower end of finger 26 is double-bent in such a manner as to allow the sloped sides of the tips 30 to lie flush when the fingers 26 and 28 are fully retracted.

A bracket 34 is affixed to the upper end of finger 28. The other finger 26 is pivotally mounted by pivot pin 36 near the lower end of bracket 34 so that the finger 26 is able to swing away from the finger 28 in an arc-like motion. The arcing motion of finger 26 is accomplished by a small expansion spring 37 attached near the top of finger 26 and the bracket 34. When the finger assembly 24 is fully retracted, the spring 37 is stretched; when the finger assembly 24 is extended the spring 37 recoils, causing finger 26 to swing up and away from finger 28 around the pivot pin 36.

The two gripping fingers 26 and 28 project through the aforementioned openings, **22*a* and 22*b* respectively, in the end cap 22. The fingers are extendable until the bracket 34 comes in contact with the inside surface of bottom cap 22, whereupon the fingers are prevented from further travel. The arcing motion of the grasping finger 26 is restricted by the confinement of finger 26 in hole 22*a*. Note that hole 22*a* is widened to an oval shape to allow for the sideways movement of finger 26**.

A link from the user to the extensible finger assembly is provided via an actuator rod 32, which extends longitudinally within the hollow body 12 of the cane from the bracket 34 towards the open top 18 of the cane. The upper section of the actuator rod 32 is slideably inserted in a sleeve 40 to guide its up and down action. The sleeve 40 is held in position by insertion into the handle 20 which is fitted into the top opening 28 of the cane body 12.

The up and down action of the actuator rod and therefore, extension of the finger assembly to which the actuator rod is connected, is accomplished by a biasing means 42. Just below the sleeve 40, the actuator rod 32 passes through a compression spring 44. The spring 44 is confined between the lower end of the sleeve 40 and a roll pin 38 inserted perpendicularly through the rod 32. When the finger assembly 24 is in its fully retracted position, the spring 44 is compressed. The finger assembly 24 is thus biased to the open, extended position.

Disposed about the lower portion of the cane 10 is a release and locking mechanism, indicated generally by the numeral 46. Illustrated also in FIGS. 1 and 2, the locking mechanism 46 communicates with the actuator rod of the finger assembly through an elongated opening **12*a* in the hollow body 12** of the cane.

The actuator rod 32 may be secured or released at any position relative to the can body 12 by the cam-type locking mechanism 46. The locking mechanism consists of a lever-operated cam surface 54 which projects inwardly through opening **12*a* into the interior of the cane body 12 and contacts the actuator rod 32. The cam surface 54 rotates around a pivot pin 50 which connects to either side of a handle flange 52 through which cam surface 54 projects. The handle flange 52 is in turn secured within the opening 12*a* in the cane body 12**.

The actuator rod 32 is bent and re-bent below the roll pin 38 to place the lower portion of the rod against and parallel to the inside surface of the hollow cane body 12. In the closed position, the cam surface 54 is rotated around the pivot pin 50 so that the lower portion of the actuator rod 32 is squeezed tightly between the cam surface 54 and the inside surface of the hollow cane body 12. Cam action is stopped as the increasing cam radius prevents further rotation of the cam surface 54 against the actuator rod 32.

A small compression spring 56 at attached by one end to the handle flange 52 while its other end fits into a depression in the underneath side of the locking mechanism handle 48. The spring 56 rotatively exerts a force on the cam surface 54 to keep it biased against the actuator rod 32.

Figure 4:
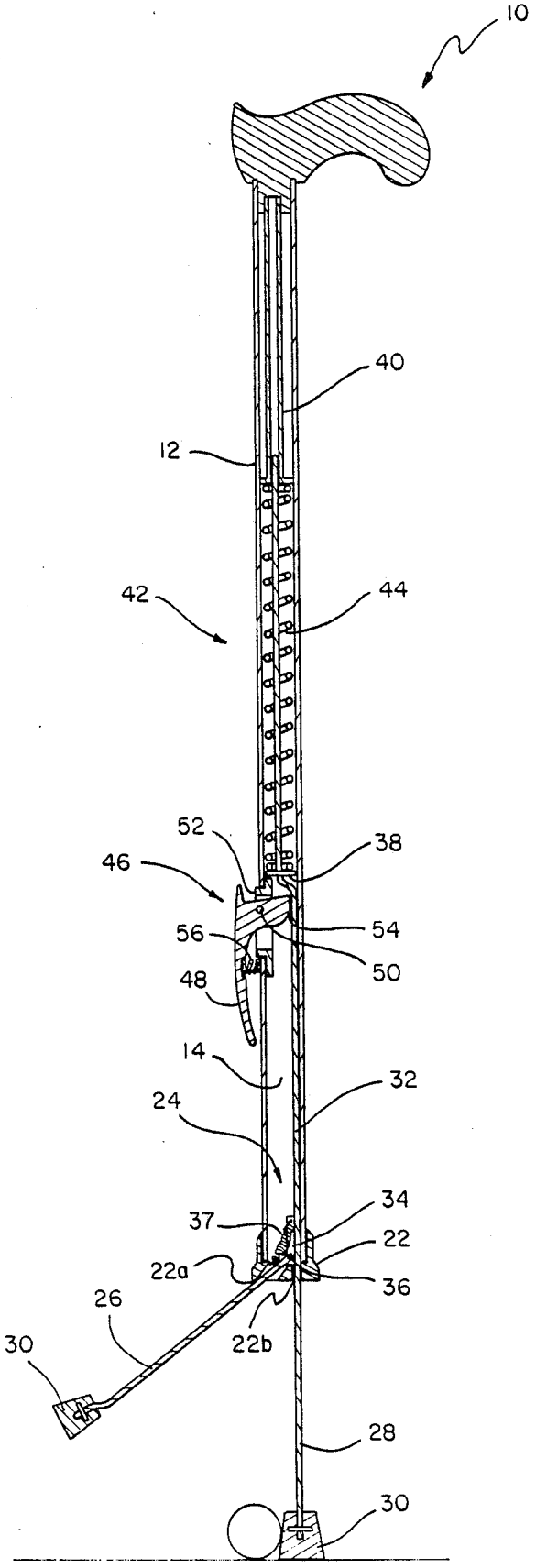
FIG. 4 is a longitudinal cross-sectional view of the cane after the release lever has been pressed and the gripping fingers fully extended.
Figure 5:
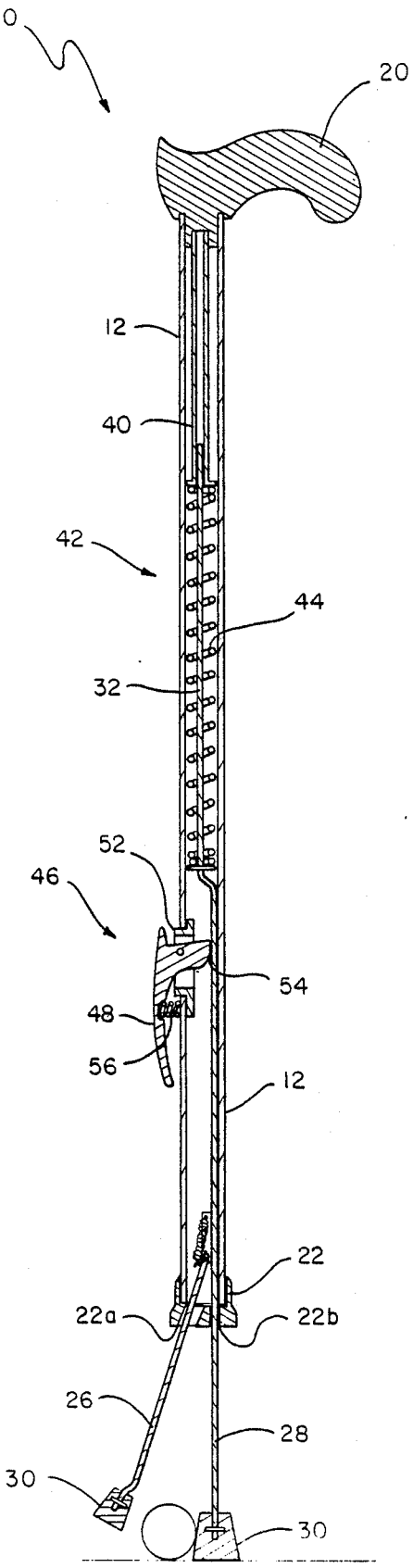
FIG. 5 is a longitudinal cross-sectional view of the cane showing the finger assembly being operated to pick up a desired object.
Figure 6:
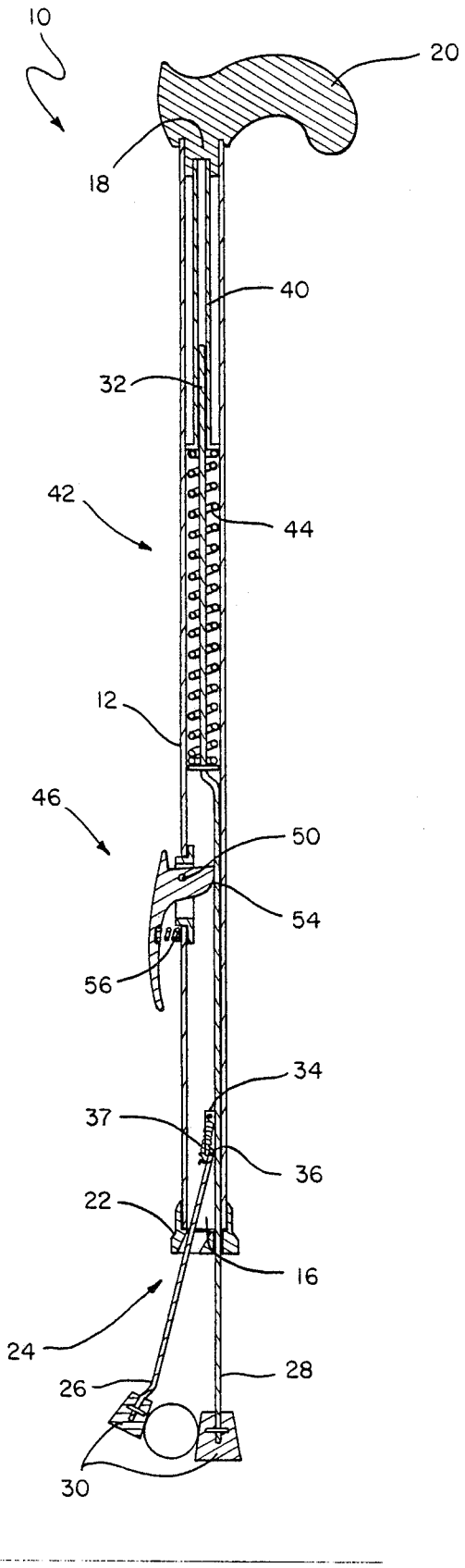
FIG. 6 is a longitudinal cross-sectional view of the cane with a desired object being clamped between gripping fingers and the release mechanism in a locked position.

The operation and use of the cane with extensible finger assembly are illustrated in FIGS. 4 through 6.

Figure 2:
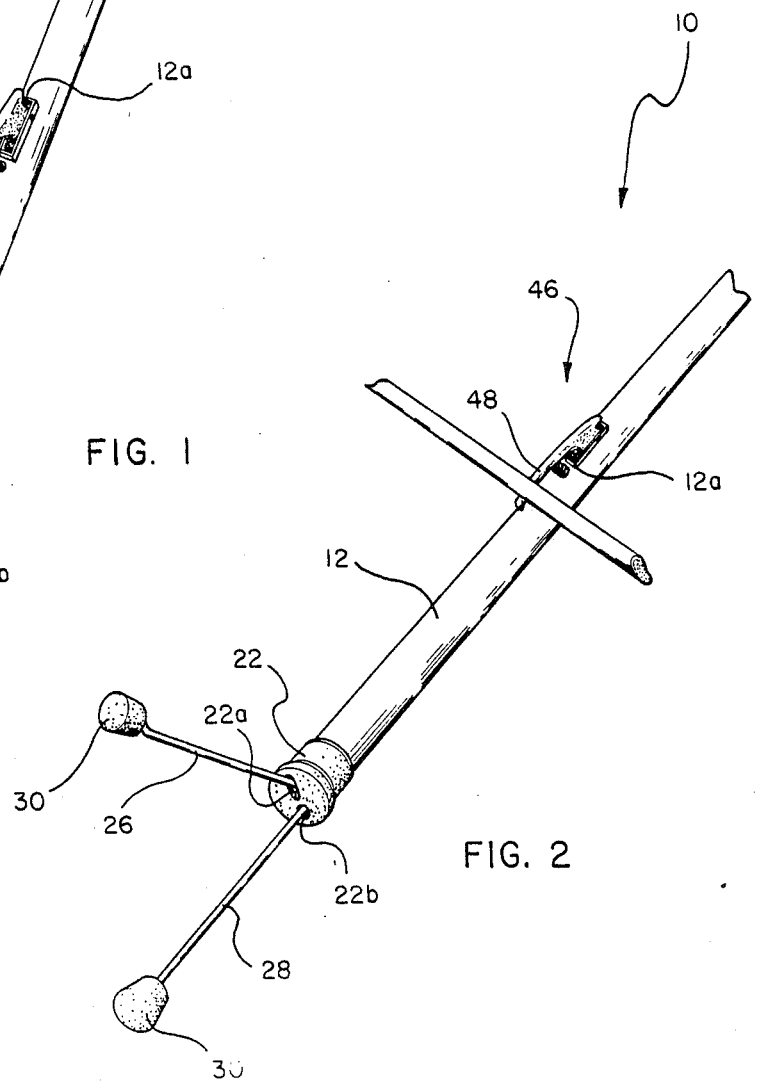
FIG. 2 is a fragmentary perspective view of the cane of the present invention showing the release lever being struck and the finger assembly in an extended, open position.

In FIG. 4, the locking mechanism 46 is released by depressing the handle 48. FIG. 2 shows the mechanism being released by striking the handle against a chair rail or like surface. The ensuing rotation of the handle 48 around the pivot pin 50 causes the cam surface 54 to rotate away from the actuator rod 32. With the cam pressure relieved, compression spring 44 extends causing actuator rod 32 to travel toward bottom opening 16 of the cane. Meanwhile gripping finger 28 slides through hole **22*b* and finger 26 slides through hole 22*a* until the bracket 34, where the one finger is pivotally connected to the other, comes in contact with the inside surface of bottom tip 22. As the fingers 26 and 28 extend, the finger 26 is lifted upward and outward as a result of the recoil of the lifting spring 37. The hole 22*a*** is oval-shaped and sloped to the outside somewhat to allow for this movement.

When the user wants to pick up an article, he places the cane with the grasping fingers extended so that the tip of the finger 28 is next to the desired object and in contact with the ground surface.

In FIG. 5, with the gripping finger 28 in position against the desired object, the user applies downward pressure on the handgrip 20. As the holes 22*a* and 22*b* in the bottom tip 22 slide down over the fingers 26 and 28, the edge of the hole 22*a* contacting the finger 26 draws that finger towards finger 28, closing the angle of the finger assembly.

Concurrently, the actuator rod 32 retracts upwardly relative to the locking mechanism 46. The upward motion of the actuator rod 32, overcoming the force exerted by spring 56, causes the cam surface 54 to roll back from, restrictive contact with the actuator rod 32. It should be, therefore, obvious that the locking mechanism 46 will, until handle 48 is depressed, prevent downward action of the actuator rod 32 relative to the cane body 12, but permits the actuator rod to slide upwardly past it.

Additionally, the upward motion of the actuator rod 32 causes compression of the spring 44. This compression has two effects. Firstly, a constant downward force is exerted on the actuator rod 32 so it will not slide readily upward thus accidentally disengaging the locking mechanism 46. Secondly, energy is stored to extend the fingers 26 and 28 when the locking mechanism 46 is purposefully released.

Finally, turning to FIG. 6, the gripping finger 26 has been brought sufficiently close to finger 28 that the desired object is clamped firmly between the cushioning tips 30. The user may now bring the object closer to himself or move it to another place as he desires. The object is released by depressing and releasing the locking mechanism 46, which will also put the finger assembly 24 in its fully extended position. The user may then pick up another object or fully retract the finger assembly by placing the tip of the finger 28 on a ground surface and pressing down on the hand grip 20 until the finger assembly assumes the position illustrated in FIG. 3.

What is claimed is:

1. A cane with extensible fingers for retrieving and picking up objects comprising (a) a cane having a hollow body and an opening at its lower end;

(b) a finger assembly mounted within the lower portion of the cane and moveable between a retracted closed position and an extended open position, the finger assembly including an elongated actuating rod extending within the cane;

(c) biasing means for biasing the finger assembly toward the extended open position;

(d) locking means for engaging the finger assembly and locking the same in any position between the extended open position and the retracted closed position; the locking means including a spring loaded cam surface for engaging the elongated actuating rod and stationing the same in a locked position so as to lock the finger assembly in a selected position wherein when the locking means is released the finger assembly is outwardly extended by the biasing means and wherein the finger assembly is closed by urging the fingers into the open end of the cane and against the biasing means, and wherein the fingers can be locked in any position while being retracted by engaging the elongated rod with the locking means.

2. The cane of claim 1 wherein the locking means is released by striking it against a surface, thereby automatically releasing the finger assembly to its extended, open position.

3. The cane of claim 1 wherein the locking mechanism is biased to the locked position whereby the finger assembly automatically assumes a locked position.

4. The cane of claim 1 wherein said finger assembly comprises a plurality of fingers each of which is enclosed within an opening within a cushioning tip secured about the lower portion of the cane.

5. A cane with extensible fingers comprising:

a cane having an open internal chamber; a finger assemble movably mounted within the cane's chamber and movable from a closed retracted position to an open extended position; means for biasing the finger assembly toward the open extended position; and latching means for locking the finger assembly in an infinite number of positions as the finger assembly is moved from the open extended position to the closed retracted position which is achieved by pushing the finger assembly inwardly into the cane's chamber against the force of the biasing means.

6. The cane of claim 5 wherein the finger assembly includes a locking member and wherein the latching means includes means for selectively engaging and locking the locking member.

7. The cane of claim 6 wherein the latching means includes a latching cam surface for engaging the locking member.

8. The cane of claim 7 wherein the latching cam surface is spring based toward a locked position where the same engages the locking member of the finger assembly and forms a binding locking relationship therewith.

9. The cane of claim 8 wherein the finger assembly includes a pair of individual fingers that are pivotly mounted such that they may move with respect to each other, and wherein there is provided means for spreading and opening the fingers in response to the fingers being biased outwardly from the cane toward their extended open position.

10. The cane of claim 9 wherein the means for spreading the individual fingers includes a cane tip secured to the bottom of the cane and including a pair of openings formed therein through which the fingers extend and wherein the openings are particularly shaped and directed such that the openings urge the fingers toward an open position in response to the latching means being released and the biasing means urging the fingers outwardly toward the open extended position.

11. The cane of claim 7 wherein the latching means includes a locking lever movably mounted adjacent the cane and operatively connected to the cam surface which engages and locks the locking member of the finger assemblies; and wherein the latching means further includes means for biasing the cam surface into a binding and locked position with respect to the locking member of the finger assembly and wherein the actuation of the lever is operative to release the cam surface from engagement with the locking member such that the finger assembly is free to move outwardly from the cane's chamber under the influence of the finger assembly biasing means.

12. A cane having extensible fingers for picking up and retrieving objects, comprising:

a. a cane with an internal chamber formed therein;

b. a finger assembly movably mounted within the chamber and including a pair of fingers movable from a retracted closed position within the chamber to an open extended position where the fingers project from the cane;

c. the finger assembly further including an actuating rod secured to the fingers and extending upwardly therefrom through the cane chamber;

d. a spring disposed within the cane's chamber and engaged with the actuating rod for biasing the actuating rod and finger assembly toward the open extended position;

e. a cane tip secured to the bottom of the cane and having a pair of openings formed therein through which the fingers extend, the openings being particularly directed to spread and open the fingers as they move therethrough in the process of moving from their closed retracted position to the open extended position; and f. a latching assembly for latching the finger assembly in an infinite number of positions between the open extended position and the retracted closed position, the latching assembly including a lever movably mounted adjacent the exterior of the cane and operatively connected to a camming surface at least partially disposed within the cane's chamber and movable from an engaged position where the same engages and binds against the actuating rod and a disengaged position where the camming surface is spaced from the actuating rod such that the actuating rod can freely move there past, and biasing means for engaging the camming surface and biasing the same toward and into the engaged position, whereby by actuating the lever the camming surface can be released from the actuating rod and the fingers extended wherein the fingers can be latched in any number of positions between the fully opened and closed positions by simply disengaging the camming surface from the actuating rod and pushing the fingers toward the retracted position and releasing the camming surface at any desired position reached so as to lock the fingers in a particular position.

* * * * *